US005531480A

United States Patent [19]

Foertsch

[11] Patent Number: 5,531,480

[45] Date of Patent: Jul. 2, 1996

[54] SKI STABILIZING DEVICE

[76] Inventor: Robert D. Foertsch, 343 W. Jefferson Rd., Butler, Pa. 16001

[21] Appl. No.: 157,567

[22] Filed: Nov. 26, 1993

[51] Int. Cl.[6] ..... A63C 11/00; A63C 5/16

[52] U.S. Cl. ..... 280/818; 280/817

[58] Field of Search ..... 280/817, 818, 280/809, 816; 434/253; 441/73; 482/71

[56] References Cited

U.S. PATENT DOCUMENTS

| | | | |
|---|---|---|---|
| 3,171,667 | 3/1965 | Wightman | 280/818 |
| 3,357,714 | 12/1967 | Kuehn . | |
| 3,703,299 | 11/1972 | Kutchma | 280/818 |
| 3,751,056 | 8/1973 | Wightman | 280/818 |
| 3,992,022 | 11/1976 | Albers | 280/818 |
| 4,828,288 | 5/1989 | Humbert . | |
| 4,936,603 | 6/1990 | Reynaud | 280/817 X |

FOREIGN PATENT DOCUMENTS

| | | | |
|---|---|---|---|
| 1127678 | 7/1982 | Canada | 280/818 |
| 2911432 | 10/1980 | Germany | 280/818 |

*Primary Examiner*—Brian L. Johnson
*Attorney, Agent, or Firm*—George C. Atwell

[57] ABSTRACT

A ski stabilizing device used in combination with a pair of skis to assist a novice skier in learning to ski includes a pair of block members, each block member attached to the inner edge of one ski adjacent the inflected tip of the ski. Each block member encases a spherical region which registers with a circular aperture located on an inside face of the respective block member. Disposed within each spherical region is a ball. Extending between the block members for connecting each ball is a connecting rod which maintains the skis at a generally fixed distance from each other. The encasement of the balls within the block members allows for the independent angular, rotational and longitudinal movement of the skis with respect to each other and with respect to the ski slope on which the novice skier is skiing. The device includes the capability to gradually enlarge or reduce the amount of angular, rotational, and longitudinal movement of the skis. By selective adjustment, longitudinal and rotational movement of each ski can be gradually enlarged or reduced in conjunction with the level of skill attained by the novice skier.

2 Claims, 4 Drawing Sheets

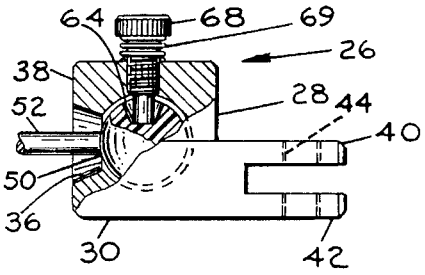
Fig. 9
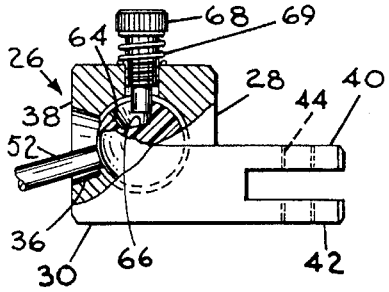
Fig. 10
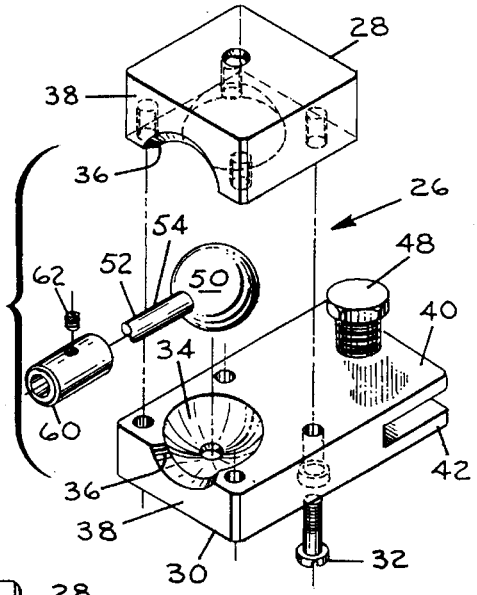
Fig. 11
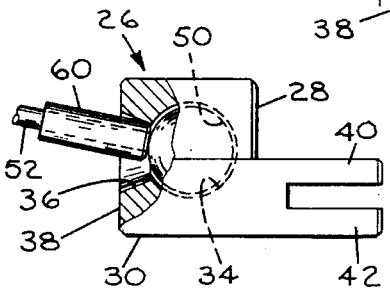
Fig. 12
Fig. 8
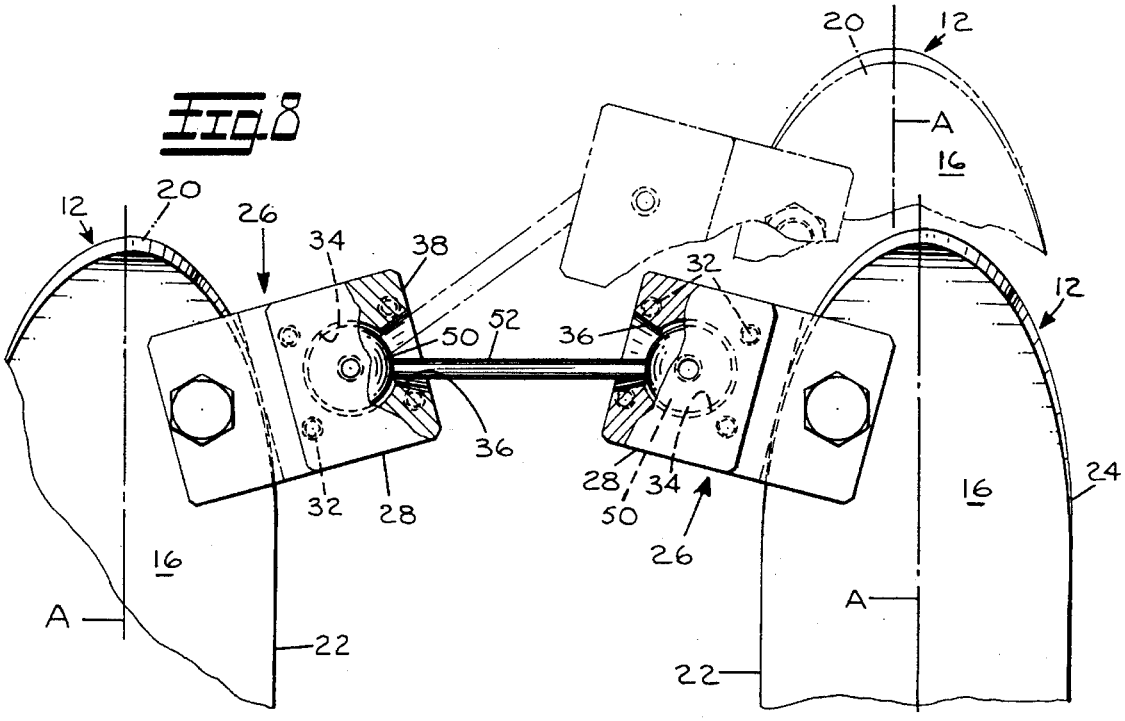

SKI STABILIZING DEVICE

BACKGROUND OF THE INVENTION

The present invention relates to ski accessories and attachments, and more particularly pertains to a ski stabilizing device for training a novice skier in downhill skiing.

In the process of learning how to ski downhill, a novice skier must master a number of skills, foremost among these are the ability to maintain the skis in a parallel, spaced relationship to one another while traversing the slope, turning the skis inward for making changes in direction while at the same time preventing the skis from crossing, and turning the inflected tips of the skis inward to the snowplow position for coming to a stop. The above movements require an amount of leg strength and stamina a novice skier does not initially possess but must acquire to successfully ski. Novice skiers tend to pick their skis up and cross them while traversing the ski slope. In addition, because of their inadequate leg strength and lack of skill, novice skiers invariably commence skiing from a spread-out position.

Skiing is an inherently dangerous sport, and novice skiers are susceptible to various injuries because of the falls they take due to the inability to control their skis. Once his or her skis open up to the spread-out position, the novice skier lacks the leg strength to pull the skis together and falls may result.

The prior art discloses numerous devices attachable to skis for assisting the novice skier in learning to ski.

Among the many devices to assist in ski instruction is the Kuehn U.S. Pat. No. 3,357,714. Kuehn discloses a device that comprises a pair of joints connected by a link. Each joint is mounted to a vertically-extending member, and each vertically-extending member is secured to each ski by screws extending upwardly through the skis and into the vertically-extending member. Kuehn also discloses several other embodiments for allowing the skis to independently rotate and diverge from each other.

The Humbert U.S. Pat. No. 4,828,288 discloses a device for linking ski tips. The device comprises a pair of attachment pieces with each attachment piece fixed to each respective ski tip. Each attachment piece has an integral arm extending toward the other ski. One integral arm terminates at a ball and the other integral arm terminates at a concave cup which fits around the ball. Thus, one pivot point is provided for the device.

The above-discussed patents disclose various solutions to the problem of assisting novice skiers in learning to ski down a slope. However, there remains a need for a device which is functional and simple, facilitates the process of learning to ski, is affordable, is easy to produce, and is quickly securable to and removable from the skis.

SUMMARY OF THE INVENTION

The ski stabilizing device of the present invention is for use in combination with a pair of skis to assist the novice skier in learning how to properly ski down a slope while minimizing injury during the learning process.

The ski stabilizing device of the present invention comprehends a pair of block members with each block member having integrally attached thereto a pair of spaced-apart flange members which receive therebetween the inner edge of the ski adjacent the inflected ski tip. A threaded fastener is inserted through either the top or bottom flange and against the surface of the ski to mount the respective block member to the ski.

The block members each define and encase an interior spherical region. The spherical region registers with a circular aperture located on an inside face of the block member; the inside face being on the opposite side of the block members with respect to the flange members. When each block member is mounted to each respective inner edge of the ski, the inside face and aperture of one block member faces the inside face and aperture of the other block member.

Disposed within the spherical region of each block member is a ball. A connecting rod has opposed ends attached to each ball for connecting the block members. The rod connects the block members to each other and extends between and maintains the skis at a generally fixed distance from each other as the novice skier skis on a slope.

When the block members are mounted to the pair of skis, each ski is capable of a variety of movements independent of the other, while at the same time, because of the connecting rod, the skis are maintained at a generally fixed distance from each other. Upon movement of the skis, the block members are able to move about the balls and are capable of moving coincident to an imaginary plane which extends perpendicular to the substantially flat portion of the skis. The skis themselves can move up-and-down and back-and-forth, and can flex through a range of angles independent of each other. The back-and-forth movement would be the longitudinal movement of the skis, and the flexing of the skis through a range of angles would be the angular movement of the skis. Angular movement of the skis allows each ski to move through a plurality of planes non-parallel to the other ski. Moreover, angular movement of the skis allows either one or both skis to move in a plurality of planes non-parallel to the slope as a result of irregularities in the surface of the ski slope.

In order to gradually and selectively reduce or enlarge the ability of the skis to move or flex with respect to each other, and thus reduce or enlarge the amount of movement of the skis, a recessed portion can be cut out or formed in each ball. Inserted through a tapped bore in either the top or the bottom of each block member is a threaded fastener, and the bore through the block will be aligned with the recessed portion of each ball. The amount of angular, rotational, and longitudinal movement of each ski can be limited or reduced by selectively and gradually inserting the fastener into the recessed portion, or enlarged by selectively and gradually withdrawing the fastener out of the recessed portion. Enlargement or reduction of the various kinds of movements of the skis would be concomitant with the degree of skill attained by the novice skier as he or she proceeds through the process of learning to ski.

It is an objective of the present invention to provide a ski stabilizing device which is simple in construction, affordable, and easily and quickly attachable and detachable to a pair of skis.

It is another objective of the present invention to provide a ski stabilizing device whereby the range and amount of angular, rotational, and longitudinal movement of the skis with respect to each other and with respect to the ski slope on which they are disposed can be gradually and selectively enlarged or limited to coincide with the skill level attained by the novice skier during the process of learning to ski.

These and other objects of the invention will become more readily apparent from an evaluation of the following description of the several preferred embodiments of this invention and by reference to the drawings appended hereto.

BRIEF DESCRIPTION OF THE DRAWINGS

FIG. 8 is a top plan view of the device first shown in FIG. 7 illustrating the longitudinal movement of one ski relative to the other ski;

FIG. 9 is a sectioned side elevational view of the device first shown in FIG. 1 illustrating an alternative embodiment of structural elements for varying the flex of the skis;

FIG. 10 is a sectioned side elevational view of the device first shown in FIG. 9;

FIG. 11 is an exploded isometric view of the device first shown in FIG. 1 illustrating the use of a bushing member to reduce the flex of the skis;

FIG. 12 is a sectioned side elevational view of the device first shown in FIG. 11;

DETAILED DESCRIPTION OF THE PREFERRED EMBODIMENT

Figure 6:
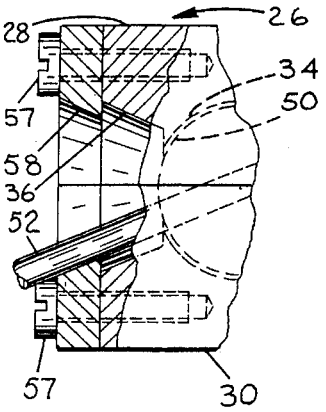
FIG. 6 is an enlarged fragmentary view in cross-section of the device, taken along line 6—6 of FIG. 5.

Illustrated in FIGS. 1–14 is a ski stabilizing device 10 for use by a novice skier in learning how to ski on a ski slope. The novice skier must master a number of skills in learning how to ski down a slope. Among these skills are the ability to keep the pair of skis in a parallel, spaced-apart disposition with respect to each other; the ability to turn the skis to maneuver around or over irregularities in the contour of the slope; and the ability to roll the skis on the inside edge while pushing the legs apart and into the wedge position to come to a stop. All of the aforementioned abilities require a degree of skill and leg strength which the novice skier does not initially have but must acquire if he or she is to become proficient in the sport and recreation of skiing.

The device 10 is adapted for removable attachment to, and used in combination with, a pair of skis 12 disposed on a ski slope 13. Each ski 12 includes a substantially elongated, flat portion 14 which defines an upper surface 16 and a lower surface 18; a front inflected tip portion 20; and longitudinal inner and outer edges 22 and 24, respectively, which extend the entire length of the skis 12. The tip 20 of each ski 12 curves or arcs upward several inches away from the portion 14. The device 10 is attached to the edge 22 adjacent each respective tip 20; and this is advantageous in that the mounting of the device 10 does not impede the movement of the skis 12 on the slope.

The device 10 includes a number of structural elements and features which allow each ski 12 to move independently in a variety of way relative to the other ski 12 and also permits the skis 12 to move in a variety of ways relative to the contour of the slope 13 on which the skis 12 are disposed. Illustrated in FIGS. 1–15 are a pair of block members 26 with each member 26 being attached to the tip 20 of that respective ski 12. Each member 26 includes an upper section 28 and a lower section 30 which are secured together by screws 32, as illustrated most clearly in FIGS. 1 and 12. When the sections 28 and 30 are assembled together, each member 26 encases or encompasses an inner socket or interior spherical region 34 which registers with a circular aperture 36 located on an inside face 38 of each member 26. The aperture 36 is formed by the sections 28 and 30 being secured to each other.

Figure 1:
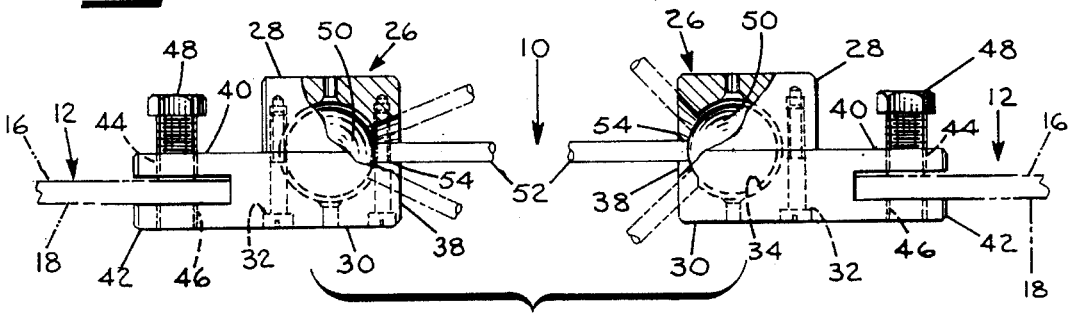
FIG. 1 is a sectioned side elevational view of the ski stabilizing device of the present invention.
Figure 2:
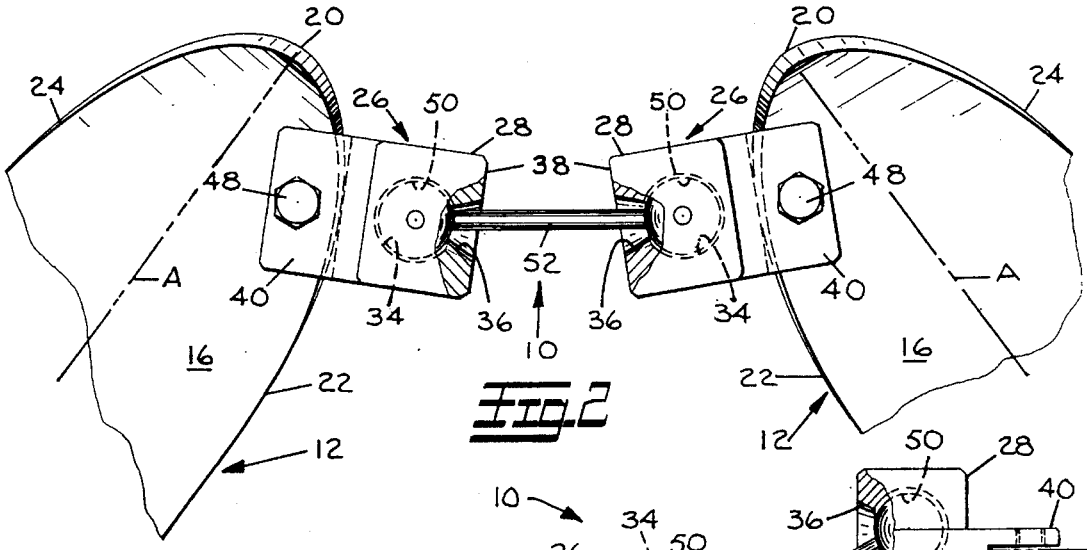
FIG. 2 is a top plan view of the device first shown in FIG. 1 illustrating the attachment of the ski stabilizing device to the tip portions of the skis.

As shown in FIGS. 2, 3, 8, and 9, when each member 26 is attached to the respective tip 20, the aperture 36 of one member 26 opens up to and faces the aperture 36 of the other member 26. As will be hereinafter further described, depending upon the range and amount of flex or movement desired for each ski 12, the diameter of the apertures 36 can be enlarged or reduced accordingly, and the depth at which the region 34 is encased within the members 26 can also be varied during the design and manufacture of the members 26. Thus, the regions 34 can be moved closer to or further away from the apertures 36; in either case, however, the regions will always register with the apertures 36. In addition, the amount or range of flex or movement of each ski 12 can be reduced or enlarged by reducing or enlarging the diameter of each aperture 36. FIG. 1 illustrates a lesser range or amount of flex in the left-hand member 26 than in the right-hand member 26. In addition, the region 34 of the left-hand member 26 is located further away from the aperture 36 than the region 34 of the right-hand member 26. Thus, the members 26 in FIG. 1 illustrate slight structural variations, but the members 26 would be equivalent in all features for any device 10 intended for actual use.

As shown in FIGS. 1–4 and 7–15, each member 26 includes an attachment means for removably attaching the members 26 to the tips 20 and a variety of different types of attachment means can be utilized. An attachment means which comprises some type of clamping means can be utilized, and this attachment means could possibly be released by the tips of the ski poles being inserted into a releasing hole or aperture on each respective member 26.

In the preferred embodiment of device 10, an attachment means is utilized which is integrally formed from the members 26. Specifically, the attachment means for each member 26 projects from the members 26 in the direction opposite the face 38. The attachment means is integrally formed from the section 30 and comprises a pair of spaced-apart flange members 40 and 42, with each flange 40 and 42 having at least one threaded aperture 44 and 46 centrally located thereon and with the apertures 44 and 46 in axial alignment. When the skier wants to attach the members 26 to the tips 20, as shown in FIGS. 2, 8, 9, and 14, he or she slides the flanges 40 and 42 onto the edge 22 and then inserts a thumb screw 48 into the aperture 44 or 46, and then the thumb screw 48 is tightened down upon the surface 16 or 18.

This is all that is required to attach the members 26 to the tips 20. Because of this means of attachment, the members 26, and the device 10 itself, do not contact the surface of the slope 13, thus skiing is not impeded by use of the device 10.

The device 10 employs a displacement means which allows the skis 12 to move independently on one another as the novice skier is skiing down the slope. Although ski slopes often have irregularities in their contours, the slope on which novice skiers learn is generally smooth and is referred to as the "beginner's slope". Because of his or her lack of skill, physical stamina, and physical strength, the novice skier wants to pick his or her legs up off the slope which leads to falls, and wants to cross the skis 12 which may also lead to a fall and possibly serious injury. Moreover, the novice skier will want to start out from a spread-out position instead of the close, but slightly spaced-apart, parallel position.

Figure 3:
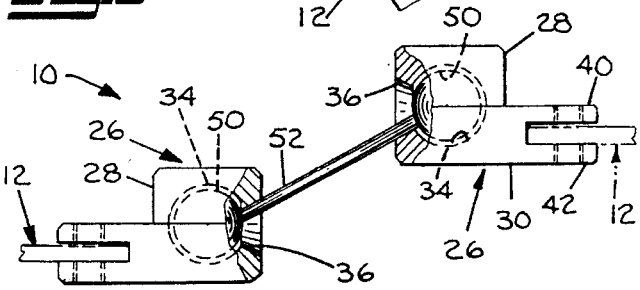
FIG. 3 is a sectioned side elevational view of the device first shown in FIG. 1 illustrating one possible position of angular displacement of the skis.

The device 10 permits certain types of movement of the skis 12 by the novice skier, which at the same time prevents the more extreme movements or positions of the skis 12, such as the cross-over position and the spread-out, or spread-eagle, position. More specifically, the displacement means allows for the flex or independent angular, rotational, and longitudinal movement of each ski 12 with respect to the other ski 12. The term "flex" can be used interchangeably with the description of the movement of the skis 12 as angular, rotational, or longitudinal, and encompasses these three kinds of movement. The displacement means allows for the movement of one ski 12 on the slope which would be independent from and could obviously occur simultaneous with the different type of movement of the other ski 12. The longitudinal movement of the skis is shown in FIG. 8, and describes a movement whereby one ski 12 is ahead of the other ski 12. FIG. 3 illustrates one type of angular movement of the skis 12 wherein the skis are disposed in non-parallel planes with respect to each other. The range of angular movement of the skis 12 with respect to each other is defined and limited by the diameters of the apertures 36; in FIG. 3 the skis are shown in one example of non-parallel displacement with respect to each other. Circular apertures with smaller diameters would reduce the amount of angular movement of the skis 12; and circular apertures having larger diameters would enlarge the amount of angular movement of each ski 12 with respect to the other.

The displacement means of the present invention as shown in FIGS. 1–12 includes a pair of balls 50 with each ball 50 disposed within the region 34. A nylon ball is preferred over a steel ball because a steel ball would require a fine finish, and because a nylon ball would not require grease or any other type of lubricant, as would a steel ball, because it is not susceptible to any problems associated with moisture or snow accumulating and icing or freezing that may occur in the minute space formed by the encasement of the ball 50 between each respective section 28 and 30.

FIGS. 1–3, 8, 9, and 13 illustrate a connection means for connecting the members 26 to each other so as to maintain the tips 20 at a fixed, parallel, spaced-apart distance from each other during skiing and yet does not prevent turning the tips 20 to the "snow plow" position for stopping. The connection means of the present invention is an elongated connecting rod 52 having opposed rod ends 54 which extend into and through each aperture 36 into the region 34. Furthermore, each end 54 is inserted and fixed into each respective ball 50. In order for the novice skier to develop the primary and essential skill of maintaining the skis 12 in a close, parallel relationship to one another when skiing, the rod 52 should be, preferably, approximately six inches long, and not more than twelve inches in length.

The assembly of the device 10 is simple. First, the ends 54 are either partially or completely inserted through and fixed into each respective ball 50. Each ball 50 is then set within the section 30 and encased within the region 34 by attaching the respective section 28. A minute clearance between the balls 50 and the region 34 formed by the attachment of the section 28 to the section 30 permits each member 26 to move about each respective ball 50.

Figure 7:
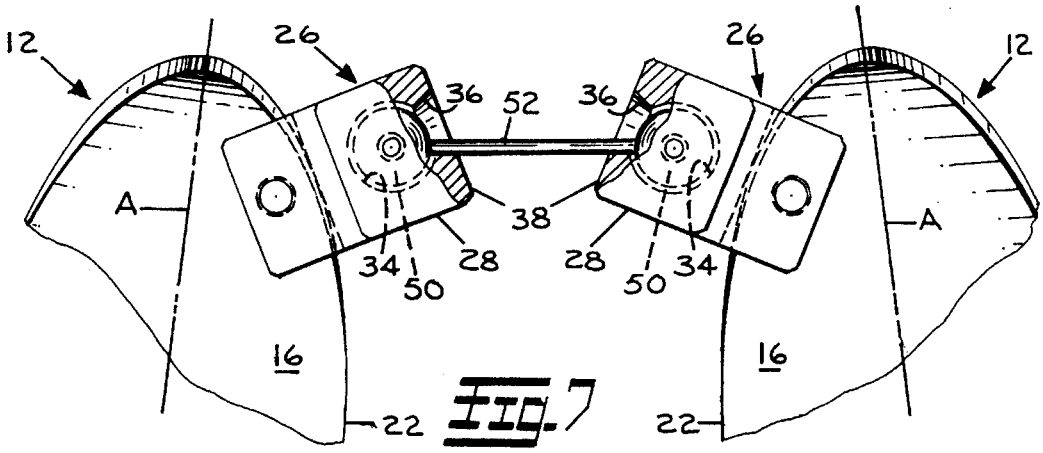
FIG. 7 is a top plan view of the device first shown in FIG. 1.

As shown in FIGS. 7 and 8, an imaginary center line axis A can be defined as extending longitudinally through the center of each ski 12 past both the rear of the skis 12 and the tips 20. In addition, an imaginary center plane (not shown) extends perpendicular to each center line axis A and each portion 14. If the skier is not disposed on the skis 12, the members 26 are capable of moving about each ball 50 coincident to the imaginary plane and in a full 360° circle within the imaginary plane. Obviously, with the skier disposed on the skis 12, the members 26 would never be able to rotate a full 360° relative to the imaginary center planes because this would require at least one full rotation by the skis 12 within the respective imaginary planes—with the skier's legs and feet fitted to the skis 12, this would be impossible. The limit of angular movement of the members 26 in any other planes extending through the skis 12 non-parallel to the imaginary center planes is defined by the distance of each region 34 from each face 38 (the depth at which each ball 50 is encased within each member 26), and also by the diameter of the aperture 36. The rod 52 does not prevent the independent angular, longitudinal, and rotational movements of the members 26 and, by extension, the skis 12, through a plurality of planes non-parallel to the imaginary center plane or non-parallel to the slope on which the skis 12 are disposed.

In the first attempt at skiing down the beginner's slope, the device 10 will be most useful in keeping the skier's legs together. As the novice skier continues practicing on the slope, he or she will acquire more skill in keeping the skis 12 parallel to one another, resisting the inclination to cross the tips 20, and avoiding the inclination to lift the skis 12 off the surface of the slope so that the skier can push or turn the skis 12 to the wedge or "snow plow" position and thus be better prepared to come to a stop.

Figure 5:
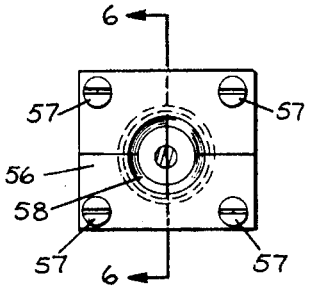
FIG. 5 is a front elevational view of the device first shown in FIG. 4.
Figure 4:
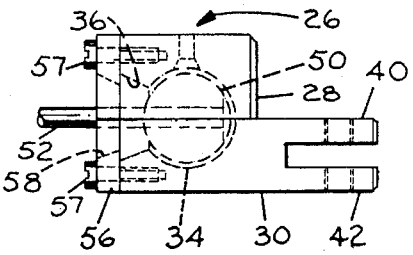
FIG. 4 is a sectioned side elevational view of the device first shown in FIG. 1 illustrating the attachment thereto of a structural element for reducing the flex of the skis.

In order to accommodate the gradual increase in skiing ability of the novice skier, the device 10 can be slightly altered so that the range of movement or amount of flex of the skis 12 can be gradually and selectively varied. One way of varying the range or amount of flex of the skis 12 is illustrated in FIGS. 4–6 which shows a face plate 56 mounted to the face 38 by means of face plate screws 57 that are inserted into the members 26. The plate 56 fully covers the face 38 except for the area defined by each aperture 36, and is preferably manufactured from a metal or hard plastic. The plate 56 includes a centrally located opening 58 axially aligned with the aperture 36 when the plate 56 is mounted to the member 26. As shown most clearly in FIG. 6, the plate 56 is only used to reduce the range or amount of flex of the device 10 because the diameter of the opening 58 is smaller than the diameter of the aperture 36, thus the range of movement of each member 26 about each respective ball 50 is reduced. Specifically, the amount of angular and longitudinal movement of the skis 12 would be reduced, but the movement of the members 26 coincident to the respective center planes would be unaffected by use of the plates 56.

Illustrated in FIGS. 11 and 12 is another way to limit or reduce the range or amount of flex of the skis 12. FIGS. 11 and 12 illustrate a bushing member 60 which is capable of slidable, reciprocable movement on the rod 52. In order to limit the range or amount of flex of the skis 12, each bushing 60 is positioned so one end of the bushing 60 abuts the surface of the respective ball 50, with a substantial portion of the bushing 60 extending through the aperture 36 as shown in FIG. 12. A set screw 62, such as shown in FIG. 11, is then tightened down upon the surface of the rod 52, thus fixing the bushing 60 in position. Utilization of the bushing 60 (one for each member 26) reduces the range or amount of angular and longitudinal movement of the skis 12 with respect to each other and thereby reduces movement of the members 26, but the bushings 60 do not affect the movement of the members 26 coincident to the center planes of the skis 12.

Yet another embodiment which allows the range or amount of flex of the skis 12 to vary is illustrated in FIGS. 9 and 10. The structural elements illustrated in FIGS. 9 and 10 differ from the structure shown in FIGS. 4–6, 11, and 12 in that FIGS. 9 and 10 illustrate a displacement variation means which is integral with each member 26, and which can be used to either reduce or enlarge the range or amount of flex of the skis 12 relative to each other and to the slope. This displacement variation means shown in FIGS. 9 and 10 permits the novice skier to selectively and gradually enlarge or reduce the range or amount of flex of each ski 12.

In the displacement variation means shown in FIGS. 9 and 10 each ball 50 has a portion of its sphere recessed or cut out. The recess 64 thus created may take many shapes; preferably, the recess 64 will be a tapered conical shape terminating at a flat bottom surface 66. Although the recess 64 could be located at the bottom of each ball 50, for ease in use by the skier in enlarging or reducing the flex of the skis 12, the recess 64 should be located at the top of each ball 50, which is that portion of each ball 50 adjacent the section 28. The section 28 includes a tapped bore extending therethrough and which is in axial alignment to the recess 64. The displacement variation means also includes a pair of elongated fasteners, such as thumb screws 68, with each screw 68 inserted into the respective bore and through the section 28. A small spring 69 can encompass the shaft of the screw 68 to provide tension for the screw 68 as it is being tightened down in the recess 64. The tips of the screws 68 are shaped in the form of an unthreaded nose piece to reduce wear from the constant surface contact of the nose piece against the walls and bottom surface 66.

In order to reduce or enlarge the range or amount of flex of one or both skis 12, the skier simply selectively adjusts the insertion of the screws 68 to varying depths within each recess 64. If the skier does not wish to utilize the displacement variation means at all, he or she simply threads the screws 68 completely out of the recesses 64 as partially shown in FIG. 10. In order to fully utilize the displacement variation means to reduce the range or amount of flex of the skis 12, the skier simply threads the screws 68 completely into the recesses 64 so that the nose pieces of the screws 68 abut the surface 66. This position is shown in FIG. 9, and represents the maximum amount of reduction in the range or amount of flex of each ski 12 using the displacement variation means. Depending upon the depth to which each screw 68 is inserted into each respective recess 64, the gradual enlargement or reduction in the range or amount of flex for each ski 12 can be selectively achieved. The displacement variation means illustrated in FIGS. 9 and 10 thus permits the novice skier to correlate the particular amount of flex with his or her level of skill.

Figure 13:
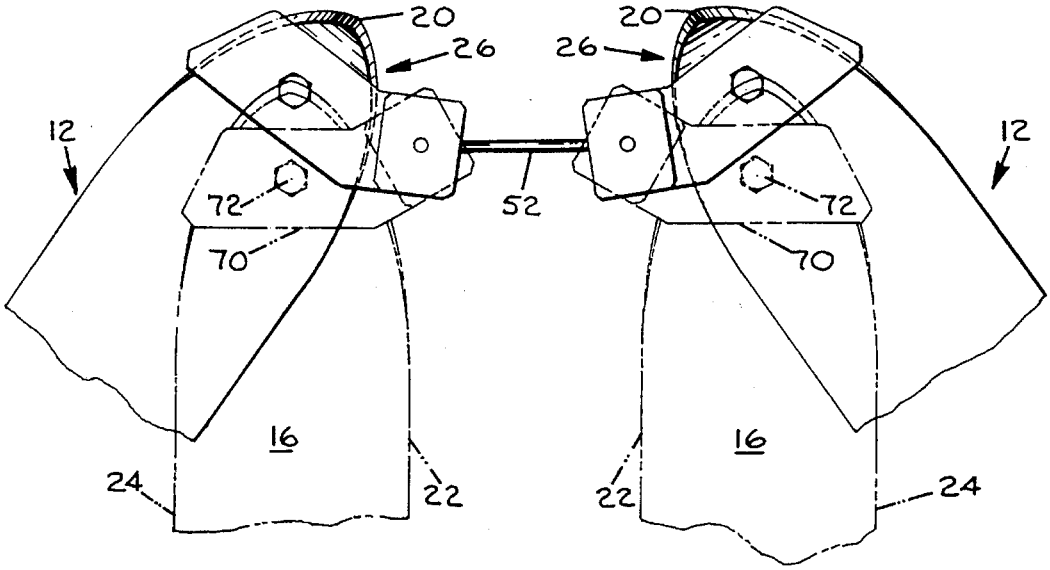
FIG. 13 is a top plan view of the device first shown in FIG. 1 illustrating an alternative embodiment for attaching the device to the skis.
Figure 14:
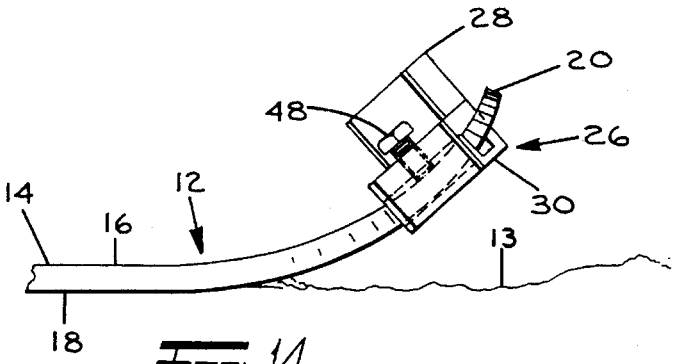
FIG. 14 is a side elevational view of the device, of FIG. 13, illustrating the attachment of the device to the tip portion of one ski.

FIGS. 13 and 14 illustrate an alternate embodiment to using the flanges 40 and 42 and the screw 48, for attaching the members 26 to the skis 12. In place of the flanges 40 and 42, FIGS. 13 and 14 show a yoke-type structure 70 which slides over each tip 20 and is then forcibly wedged onto the ski 12. A thumb screw 72 is then inserted through the top of the structure 70 and tightened down upon the surface 16 to firmly hold the member 26 to the ski 12.

Figure 15:
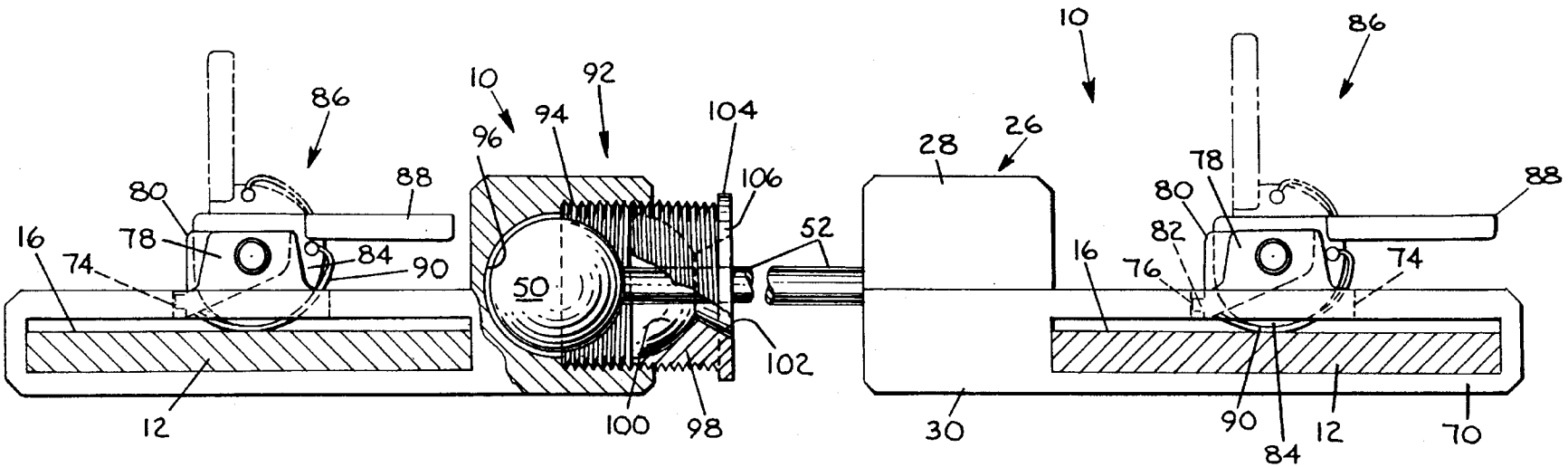
FIG. 15 is a cross-sectioned side elevational view of the ski stabilizing device illustrating a cam and lever unit for attaching the device to the skis and an insert for forming the socket for the ball.

An alternative embodiment for attaching each member 26 to each tip 20 is illustrated in FIG. 15 and can be incorporated with the flange 40 of FIGS. 1–3 and 7–8, as well as the structure 70 illustrated in FIG. 13. In order to integrate the alternative attachment means with the flange 40, a longitudinal slot 74 must be cut into and completely through the flange 40 to the distal edge thereof. The slot 74 includes a notched or recessed portion 76 extending slightly into the body of the flange 40 adjacent the section 30. Secured to the upper surface of the flange 40, and on the top member of structure 70, are a pair of equally-sized, spaced-apart mounts 78. The mounts 78 project upward but at a height less than that of the section 28, and include axially aligned pinholes. Disposed within the slot 74 and between the mounts 78 is a friction plate 80. The sides of the plate 80 fit snugly against the opposed vertical sides of the slot 74 and the flat inner vertical surfaces of each mount 78. The sides of the plate 80 include axial pinholes which align with the pinholes of each mount 78 when the plate 80 is disposed therebetween. The plate 80 includes a small projection or ledge 82 which is inserted into the notch 76 to help maintain the position of the plate 80 between the mounts 78. Fitted against the sides of the plate 80 is a cam portion 84 of an integral cam and lever member 86.

The cam portion 84 has an aperture extending therethrough which aligns with the pinholes of both the plate 80 and the mounts 78 so that the member 86 can be rotatably secured between the sides of the plate 80 and the mounts 78. When a lever 88 is pushed down to engage the cam portion 84 against the surface 16, the lever 88 extends horizontal and parallel to the surface 16; when the member 86 is in its disengaged position, the lever 88 will extend upright and perpendicular to the surface 16.

As shown in FIG. 15, when the member 86 is engaged, the cam portion 84 protrudes very slightly into the slot 74 and against the ski 12. The thrust or wedging action of the cam portion 84 abuts the ski 12 as the lever 88 is easily pushed down, and such action provides more than adequate wedging force to hold the member 26 onto the ski 12. In order to prevent marring the surface 16 by the cam portion 84 when the member 86 is disposed in the engaged position, a flexible, elongated nylon member 90 is provided for the cam portion 84 to rotate and slide upon. The member 90 has one end attached to the plate 80 and the other end fixed to the cam portion 84, and the member 90 abuts the surface 16 but is no wider than the cam portion 84 so as to fit within the slot 74. As the member 86 is being engaged or disengaged, the member 90 simultaneously rolls out or up concomitant with the rotation of the cam portion 84. The member 90 does not retract into the cam portion 84 or plate 80 but simply follows the rotatable movement of the cam portion 84. The member 90 could be rubber coated for enhancing its gripping action against the surface 16 when the lever 88 is pressed down to secure the member 26 to the ski 12.

In addition, as shown in FIG. 15, the members 86 can pivot in either direction with respect to the members 26. The member 86 mounted to the right-hand side of the device 10 of FIG. 15 is mounted so that the lever 88 points away from the member 26 when the lever 88 is pressed down so that the cam portion 84 engages and is wedged against the surface 16. The member 86 mounted to the device 10 on the left-hand side of FIG. 15 is mounted so that the lever 88 points toward the member 26 when the lever 88 is pressed down so that the cam portion 84 engages and wedges against the surface 16.

The device 10 shown on the left-hand side of FIG. 15 illustrates an alternative block member structure which performs the same function as the member 26 of FIGS. 1–14. Unlike the member 26 which comprises sections 28 and 30 secured together by screws 32 as shown in FIGS. 1–14, the block member 92 in FIG. 15 is a one-piece unit which includes an annularly threaded bore 94 terminating inwardly at a semicircular pocket 96 which seats the ball 50. The bore 94 opens up opposite of the member 86 and faces the other member 26 when the device 10 is secured to the ski.

In order to fully enclose and seat the ball 50 within the pocket 96, an annularly threaded circular insert 98 is threaded into the bore 94. The insert 98 is a unique structure in that it includes an interior semicircular or concave-shaped portion 100 and a sloped circular aperture 102 which registers with the portion 100 to allow extension of the rod 52 therethrough for attachment to the ball 50. The aperture 102 performs the same function as the aperture 36 in that the aperture 102 defines the range of movement of the rod 52 during flexing of the skis 12. When the insert 98 is fully threaded into the member 92, the portion 100 encloses the ball 50 so that the pocket 96 and the portion 100 form the socket within which the ball 50 can rotate and move. The device 10 preferably comes with the insert 98 already on the rod 52, and in order to vary the range of flex of the skis 12, the skier simply backs the insert 98 away from the pocket 96 a given distance. By unthreading and backing the insert 98 away from the pocket 96 and the ball 50, the movement of the rod 52 within the aperture 102 is reduced, thus the range or amount of flex of the skis 12 is also reduced. In order to facilitate the threading of the insert 98 into the member 92, the insert 98 includes an annular flange 104 and two opposed wrench flats 106. A wrench (not shown) is engaged upon the flats 106, making the threading or unthreading of the insert 98 into the member 92 much easier to accomplish.

While certain modifications and embodiments of the invention have been described, it is, of course, to be understood that there are a great number of variations which will suggest themselves to anyone familiar with the subject matter and which may come within the scope and spirit of the appended claims.

I claim:

1. A ski stabilizing device for use in combination with a pair of skis disposed for skiing on a ski slope whose contour varies from level to irregular with each ski having a substantially elongated, flat portion, a front, inflected tip portion, and longitudinal inner and outer edges extending the length of the skis, the ski stabilizing device comprising:

a pair of block members with each block member encasing a spherical region which registers with a circular aperture that is located on an inside face of each block member, the circular apertures facing each other when the block members are mounted to the skis;

an attachment means projecting from each block member opposite the inside face of each block member for removably attaching the block members to the respective inflected tip portion of each ski edge so that the block members do not contact the slope and impede skiing;

a connecting rod which attaches one block member to the opposite block member for maintaining the skis at a generally fixed distance from each other during skiing but does not prevent the independent movement of the skis through a plurality of planes relative to the slope;

the connecting rod characterized by opposed rod ends which extend through each circular aperture and into the spherical region of each block member;

displacement means for allowing independent angular, rotational, and longitudinal movement of each ski with respect to the other ski while the skier is skiing down the slope;

the displacement means including a pair of balls with each ball fixed to a respective end of the connecting rod for encasement within the spherical region of each respective block member; and a pair of slidable bushing members with each bushing member removably securable to the connecting rod adjacent a point where the balls are mounted to the rod ends so that each bushing member extends through each circular aperture for reducing the amount of angular and longitudinal movement of the skis.

2. A ski stabilizing device for use by a skier in combination with a pair of skis disposed for skiing on a ski slope whose contour varies from level to irregular, with each ski having a substantially elongated, flat portion, a front, inflected tip portion, and longitudinal inner and outer edges extending the length of the skis, the ski stabilizing device comprising:

a pair of block members with each block member encasing a spherical region which registers with a circular aperture that is located on an inside face of each block member, the circular apertures facing each other when the block members are mounted to the skis;

an attachment means projecting from each block member, opposite the inside face of each block member, for removably attaching the block members to the inflected tip portion of each inner ski edge so that the block members do not contact the slope and impede skiing;

a connecting rod which attaches one block member to the opposite block member for maintaining the skis at a generally fixed distance during skiing but does not prevent the independent movement of the skis through a plurality of planes relative to the slope;

the connecting rod characterized by opposed rod ends which extend through each circular aperture and into the spherical region of each block member;

displacement means for allowing independent angular, rotational, and longitudinal movement of each ski with respect to the other ski while the skier is skiing down the slope;

displacement variation means integral with each block member for gradually and selectively enlarging or reducing the amount of angular, rotational, and longitudinal movement of each ski;

the displacement variation means characterized by:

a pair of balls with each ball fixed to a respective end of the connecting rod for encasement within the spherical region of each respective block member;

a recessed portion formed in each ball;

a pair of elongated fasteners with one fastener inserted through one block member and into the recessed portion of that respective ball and the other fastener inserted through the other block member and into the recessed portion of that ball; and the fasteners being longitudinally adjustable to varying depths within the recessed portions of the balls to allow either a gradual enlargement or a gradual reduction in the amount of angular, rotational, and longitudinal movement of each ski.

* * * * *